US005184431A

United States Patent [19]

Combrowski et al.

[11] Patent Number: 5,184,431

[45] Date of Patent: Feb. 9, 1993

[54] APPARATUS FOR THE GRINDING OF WORKPIECES, ESPECIALLY TOOLS

[76] Inventors: Zbigniew Combrowski, Kreuzstr. 66; Armin Hamma, Schaffhauser Str. 13, both of D-7200 Tuttlingen, Fed. Rep. of Germany

[21] Appl. No.: 721,602

[22] PCT Filed: Jan. 22, 1990

[86] PCT No.: PCT/DE90/00033

§ 371 Date: Jul. 18, 1991

§ 102(e) Date: Jul. 18, 1991

[87] PCT Pub. No.: WO90/08011

PCT Pub. Date: Jul. 26, 1990

[30] Foreign Application Priority Data

Jan. 20, 1989 [DE] Fed. Rep. of Germany ... 8900586[U]

[51] Int. Cl.[5] ..... B24B 3/26

[52] U.S. Cl. ..... 51/219 R; 51/218 A

[58] Field of Search ..... 51/217 R, 217 T, 217 A, 51/218 R, 219 R, 219 PC, 218 A, 218 T

[56] References Cited

U.S. PATENT DOCUMENTS

| | | | |
|---|---|---|---|
| 2,432,058 | 12/1947 | Wiken | 51/217 A |
| 3,073,076 | 1/1963 | French | 51/225 |
| 3,680,268 | 8/1972 | Lorton | 51/218 A |
| 4,769,955 | 9/1988 | Reiling | 51/218 A |

*Primary Examiner*—Bruce M. Kisliuk
*Assistant Examiner*—Jack Lavinder
*Attorney, Agent, or Firm*—Bachman & LaPointe

[57] ABSTRACT

Appliance for the machining of workpieces, especially tools, such as, for example, for the grinding of drills, with a machining device, for example a double grinding unit, and with a receiver assigned to this and intended for the workpiece. The machining device is assigned a basic stand for the guidance of a carriage, to which is fixed a further guide serving for guiding a further carriage which is itself assigned a lathe attachment or rocker holder with an axis of rotation (B), which is connected to a bearing pedestal or a rocker, on which the receiver or a quick-change holder is arranged.

20 Claims, 10 Drawing Sheets

APPARATUS FOR THE GRINDING OF WORKPIECES, ESPECIALLY TOOLS

The invention relates to an appliance for the grinding of workpieces, especially tools, such as, for example, for the grinding of drills, with a machining device, for example a double grinding unit, and with a receiver assigned to this and intended for the workpiece The main problem of appliances of this type is to bring the workpiece to be machined to an exact and desired angle relative to the machining device and to maintain it there. Even today, for example, drills are resharpened by hand on a grinding block, how the drill is moved in relation to the grinding wheel still being left to the skill and experience of the machinist. The cutting geometry plays a very considerable part in these very situations.

The inventor's object was to develop an above-mentioned appliance, by means of which a workpiece to be machined can be brought at any angle up to a corresponding machining device, so that extremely versatile machining becomes possible.

To achieve this object, the machining device is assigned a basic stand for the guidance of a carriage, on which is fixed a further guide serving for guiding a further carriage which is itself assigned a lathe attachment or a rocker holder with an axis of rotation, connected to a bearing pedestal, on which the receiver or a quick-change holder is arranged.

The carriages moveable in the guides as a rule execute a movement in the x-axis and y-axis respectively. The two axes of rotation allow the workpiece to be machined to be assigned to all the other angles of this plane.

In a preferred exemplary embodiment, the bearing pedestal is so connected to the lathe attachment that an axis of rotation is formed here too.

A pivoting of the bearing pedestal through 180° in the C-axis thereby becomes possible. This guarantees any possible angular position of the workpiece in relation to the machining device.

In addition, the receiver and bearing pedestal will also form yet another axis of rotation with one another. Since the axis of the receiver is exactly in line with the axis of the lathe attachment, this last-mentioned axis of rotation makes it possible to insert into the receiver longer workpieces to be machined which would otherwise strike against the lathe attachment when being inserted through the receiver.

In a preferred exemplary embodiment, the receiver itself is rotatable about its longitudinal axis and, furthermore, forms an axis of rotation with a fork. The fork connects the receiver to the bearing pedestal.

All the axes of rotation are to be assigned corresponding scale rings, and moreover it is intended to make it possible to release the individual rotatable parts by means of quick-acting chucking levers or clamping screws.

The guides for the carriages are so designed that they consist of a threaded spindle and of two guide rails. The threaded spindle and guide rails pass through the carriages, the threaded spindle meshing with a corresponding internal thread in the carriage. The guide rails run free of play and are sealed off against dirt by means of concertinas.

Each threaded spindle is assigned a rotary grip with appropriate scaling, this rotary grip rotating the threaded spindle. A fine adjustment of the carriage thereby becomes possible. At the same time, the scaling can be reset to zero.

However, it is also intended to provide a rapid adjustment of each carriage. For this, a lever with an appropriate engagement profile for the threaded spindle passes through the carriage. When this lever is lifted out counter to the force of a spring or a cup-spring assembly and, if appropriate, locked by pivoting, the engagement with the threaded spindle is cancelled and the carriage can be moved along on the guide rails. Fixing near the desired position is then obtained again by releasing the lever, so that the profile engages into the thread flights of the threaded spindle. Fine adjustment then takes place once more via the rotary grips.

Moreover, all the rotatable and moveable parts are clampable, whether by corresponding clamping screws or by quick-acting chucking levers.

In a further embodiment, the quick-change holder possesses a quick-acting clamping bolt which is received in a corresponding receiving bore of the rocker holder. When it is desired to exchange an entire quick-change holder, the quick-change holder to be removed can be drawn out of the receiving bore of the rocker holder, for example by the release of a corresponding clamping screw.

According to the invention, an indexing drum is inserted in a quick-change holder. Additionally, reverse grinding is possible by means of a 12-division. It is possible, for example, to insert a quick-change holder with a jaw chuck into the rocker holder.

This ensures an accurate plane and concentric running of the workpiece, since all the parts are connected firmly to one another. For the alignment of drill bits for example, a magnifying glass or an aligning holder can also additionally be assigned.

In this second embodiment of the invention, the entire working device is connected exchangeably to the corresponding carriage via a rocker holder. For this, there projects from the carriage a corresponding guide bolt which engages into the rocker holder and which is fixed there, for example by means of a clamping screw. The rocker holder, together with the quick-change holder and a rocker described below, is rotatable about this guide bolt.

Arranged between the rocker holder and the quick-change holder is a rocker which passes through the rocker holder and which forms with this a further axis of rotation extending approximately perpendicularly to the axis of rotation about the guide bolt. As described above, the quick-change holder too is to be connected releasably to the rocker. It is thereby possible to exchange receiver units for different workpieces very quickly and without much trouble.

The quick-change holder itself forms an axis of rotation with the rocker, this axis of rotation preferably extending approximately parallel to, but radially offset in relation to, the axis of rotation of the rocker. Moreover, this quick-change holder is so designed that it rotates about the axis of rotation just mentioned in a plane parallel to the main axis of rotation of the rocker holder, an arm then projecting approximately perpendicularly to this plane and holding the receiver for the workpiece there.

The longitudinal axis of this receiver is then itself arranged in a plane approximately parallel to the main axis of rotation of the rocker holder.

Preferably, the quick-change holder is likewise located by means of a receiving bolt in a receiving bore of the rocker and is held there with a clamping effect. This receiving bolt is then preferably assigned two scales, one scale serving for setting the quick-change holder and the other scale for the clearance-angle setting for surface grinding.

The double grinding unit possesses a locating spring and a clamping bore. This can be inserted and clamped in a locating groove on the machine table. A pivoting of the double grinding unit into various positions is thereby possible.

The present appliance is suitable above all for the grinding of single-bit, two-bit and multi-bit drilling tools made of HSS and HM and other materials. It is does not matter whether these drilling tools are of the left-hand or right-hand cutting type. Depending on the chucking system, diameters of 0.5 mm to 42 mm can be machined, and the point angle can be 0° to 180°. Sharpening the drilling tool to a point is readily possible. The clearance angle is from 0° to 20° for cylindrical grinding and from 0° to 60° for surface cutting.

Further possible uses are single-bit milling with a point angle of 0° to 180° and the grinding of outer radii from the center and relief grinding.

Furthermore, centering tools and countersinking tools of all types can be machined. The machining of milling cutters with a diameter of 2 mm to 140 mm is possible both on their end face and on their circumference. Moreover, lathe, plane and forming-lathe cutters made of HSS or HM, but also progressive cutting tools can be ground.

This list is merely illustrative.

Further advantages, features and details of the invention emerge from the following description of preferred exemplary embodiments and with reference to the drawing; in this:

Figure 1:
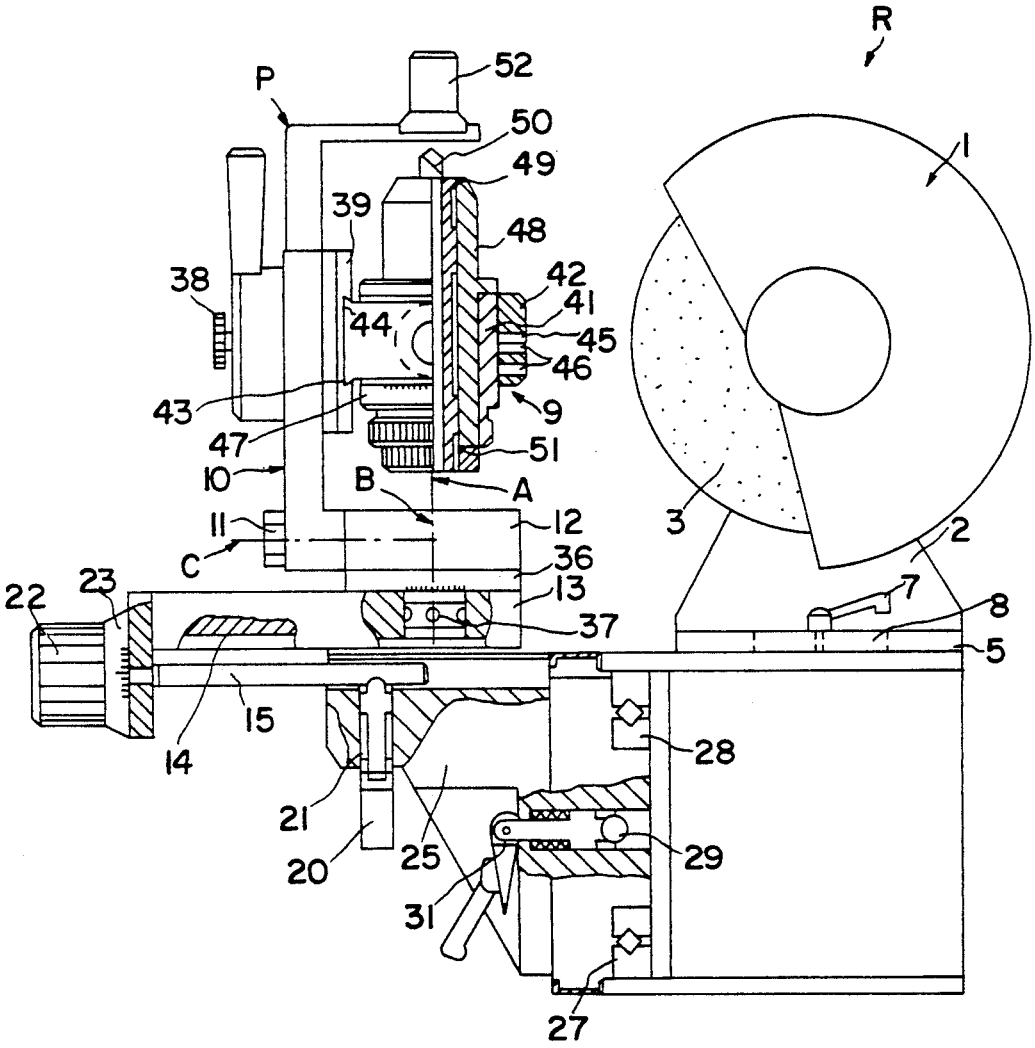
FIG. 1 shows a partially sectional side view of a grinding device according to the invention.
Figure 3:
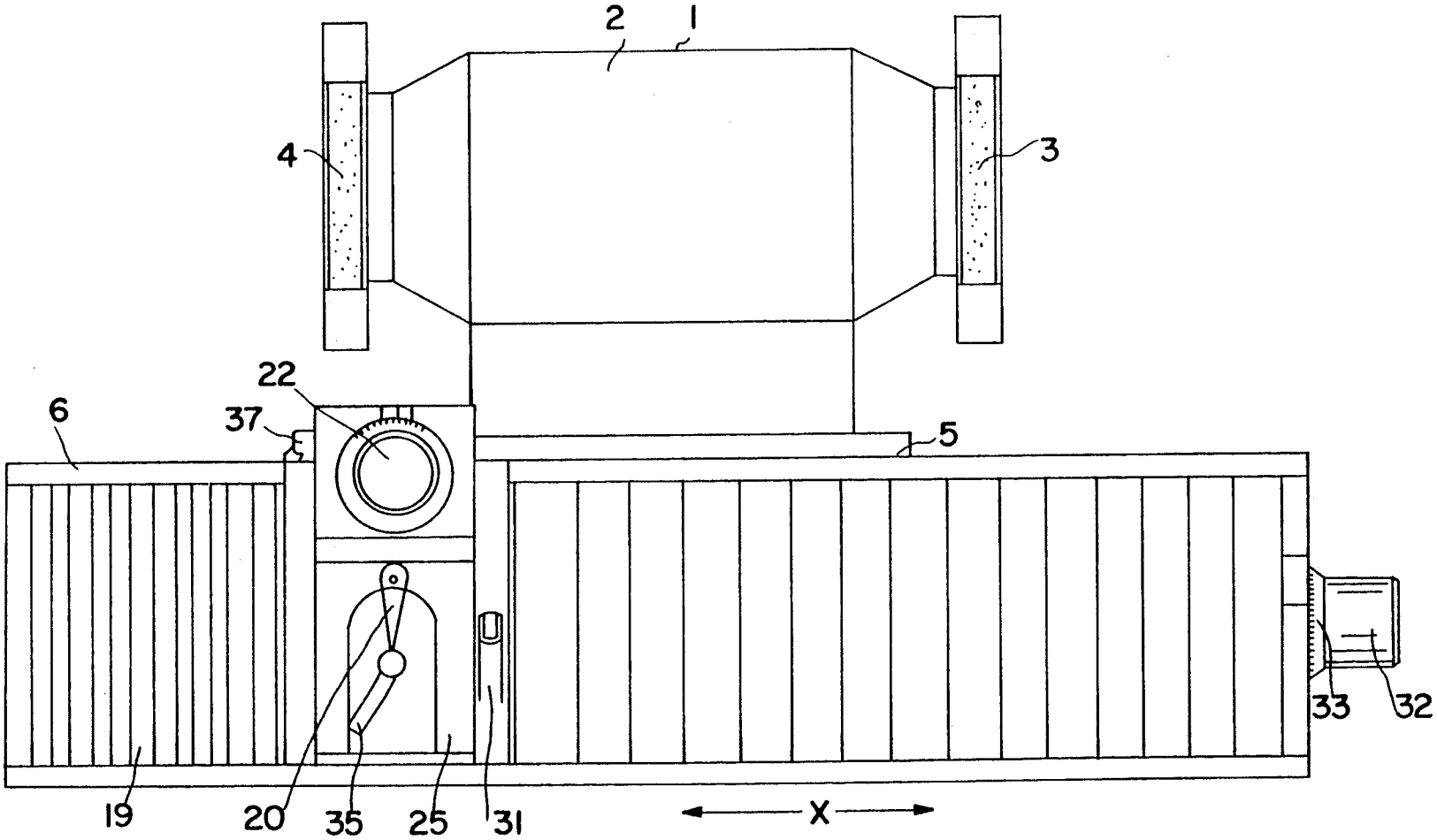
FIG. 3 shows a partial front view of the grinding device.

According to FIG. 1, a grinding device R possesses a double grinding unit 1 consisting essentially of a motor block 2, via which a grinding wheel 3 and 4 is driven on each of the two sides. The double grinding unit 1 includes, furthermore, a bearing frame 5 which rests on a basic stand 6 (see FIG. 3).

The bearing frame 5 is retained via corresponding screws by means of quick-acting clamping levers 7 which pass through long holes 8 represented by broken lines.

The double grinding unit is thus designed displaceably, and furthermore it can be pivoted in reverse into three positions, each rotated through 90°. This affords a time saving during the changeover of the grinding wheels.

A drill receiver as part of a working device P is designated as a whole by 9 in FIG. 1. This drill receiver 9 is fixed in a bearing pedestal 10 which is connected to a lathe attachment 12 via a screw bolt 11. This lathe attachment 12 is arranged on a carriage 13 which is moveable along a guide 14. At the same time, according to FIG. 2, this guide 14 consists essentially of a middle threaded spindle 15 and of two lateral guide rails 16 and 17. Both the guide rails 16 and 17 and the threaded spindle 15 pass through the carriage 13, but the threaded spindle 15 meshes with a corresponding internal thread in the carriage 13. The guide rails 16 and 17 run free of play and are protected against dirt.

The coarse setting of the carriage 13 is obtained as result of a movement along the guide 14, a lever 20 being pivoted counter to the force of a spring 21 out of its engaged position with the threaded spindle 15. As soon as the desired position is reached approximately, the lever 20 is pivoted back so that its appropriately profiled end face engages into the thread flights of the threaded spindle 15. The fine setting of the carriage position can now take place, this being carried out by means of a corresponding rotary grip 22 with a scaling 23. The threaded spindle 15 is rotated by means of this rotary grip 22, whereas the carriage 13 is held by the guide rails 16 and 17. The adjustment is made within the 0.01 mm range.

The Y-axis guide 14 rests on a carriage 25 which is connected to the basic stand 6 via guides 27 and 28 and through which a threaded spindle 29 passes.

The carriage 25 is guided on the basic stand 6 in a similar way to that described with regard to the carriage 13. Here too, the rapid adjustment is made by a lever 31, whilst the fine setting is carried out by a rotary grip 32 with a corresponding scaling 33. The covers of the guides 27, 28 are received a concertina 19.

The following possibilities of movement are thus obtained:

The carriage 25 is moveable in the direction x along the basic stand 6. A displacement of the carriage 13 along the guide 14 allows a movement of the drill receiver 9 in the direction y.

The lathe attachment 12 has an axis of rotation B with the carriage 13, a further scale ring 36 being provided here too.

A further rotation through 180° is guaranteed by the release of the screw bolt 11, this rotation taking place about the axis of rotation C. It thereby also becomes possible to insert longer workpieces to be machined into the drill receiver 9.

Moreover, the rotation about the axis of rotation B can also be permitted by means of a further quick-acting clamping lever 37. This is indicated only in FIGS. 1 and 3.

Figure 2:
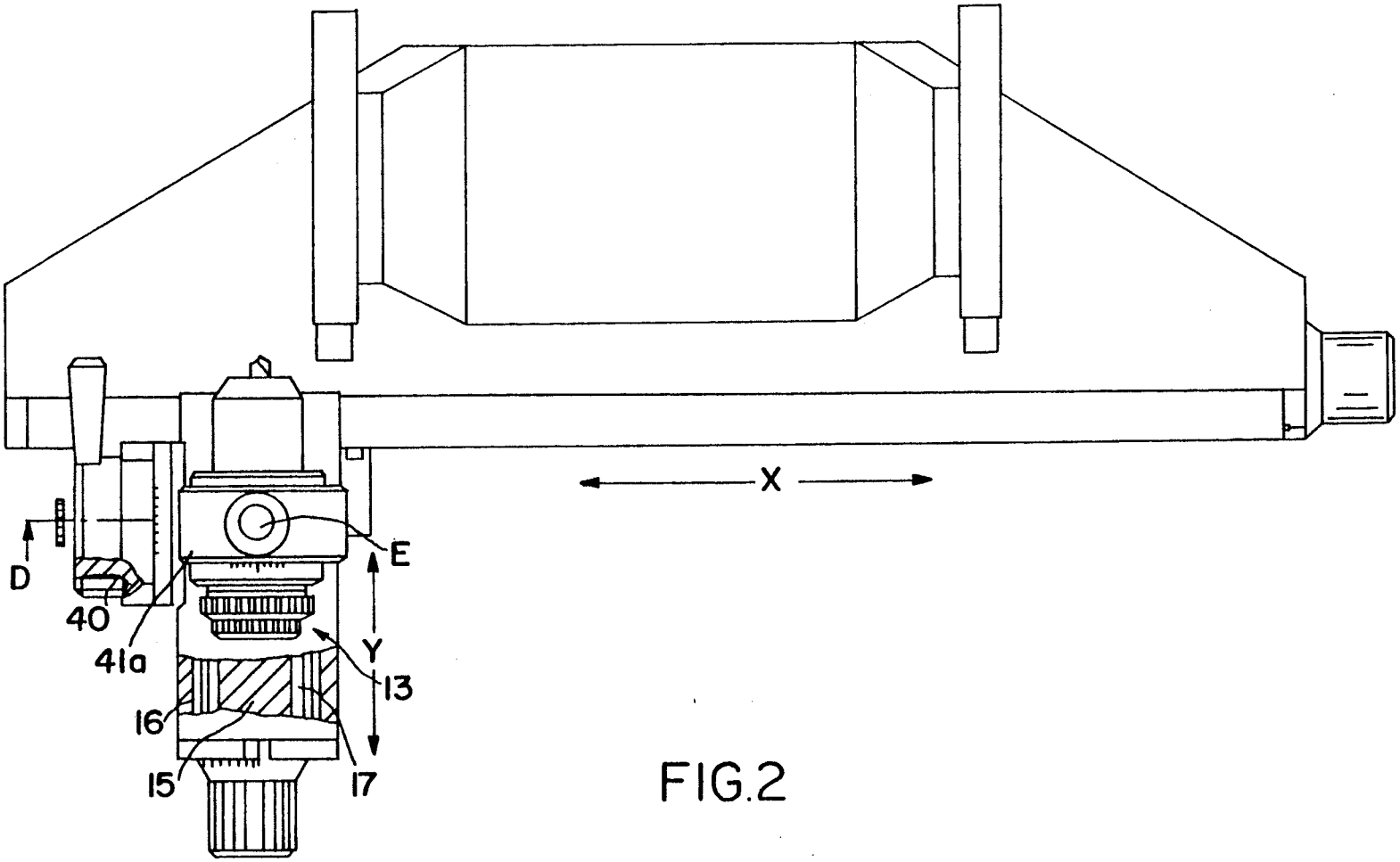
FIG. 2 shows a top view of the grinding device according to FIG. 1.

For the drill receiver 9, there is, in turn, a possibility of rotation through 360° which becomes possible as result of the release of a further quick-acting clamping lever 38. As result of this release, a rocker 39 with a corresponding scaling is relieved, so that the drill receiver 9 can be pivoted about a further axis of rotation D. Furthermore, as shown in FIG. 2, between the rocker 39 and the bearing pedestal 10 are arranged four ball catches 40 which are respectively offset at 90° and which allow four corresponding positionings.

The drill receiver 9 rests by means of a basic receiver 41 in a guide bush 42 which engages with a dovetail 43 into a corresponding groove 44 of the rocker 39. The drill receiver 9 can thereby be exchanged quickly.

Moreover, the mounting of the basic receiver 41 in the guide bush 42 is free of play, a corresponding V-slot 45 being formed in the basic receiver 41 and being assigned a ball catch 46.

Exact positioning and reverse grinding are possible with this ball catch 46 and a scale ring 47 as results of a 12-division.

A quick-change receiver 48 is inserted into the basic receiver 41. This quick-change receiver 48 surrounds a collet chuck 49. The quick-change receiver 48 is mounted in the basic receiver 41 by means of a locating bore accurately in terms of concentric running and plane support and can be locked in specific positions.

By means of various quick-change receivers 48, different types of collet chucks 49 can be used, as required. The quick-change receiver 48 is also obtainable as a cutter holder and quick-change holder with different Morse taper sizes (MK 1–4) and as a drill chuck. The tightening of the collet chuck 49 after the insertion of a corresponding drill 50 is obtained by means of a tightening nut 51. The bits of the drill 50 can be aligned in the cross hairs of a magnifying glass 52.

FIG. 2 illustrates, furthermore, that the basic receiver 48 is arranged in an additional fork 41*a* and with this forms an axis of rotation E. This fork 41*a* then also engages with the dovetail 43 into the groove 44. A pivoting of the receiver 9 about the axis of rotation E thereby becomes possible.

Figure 4:
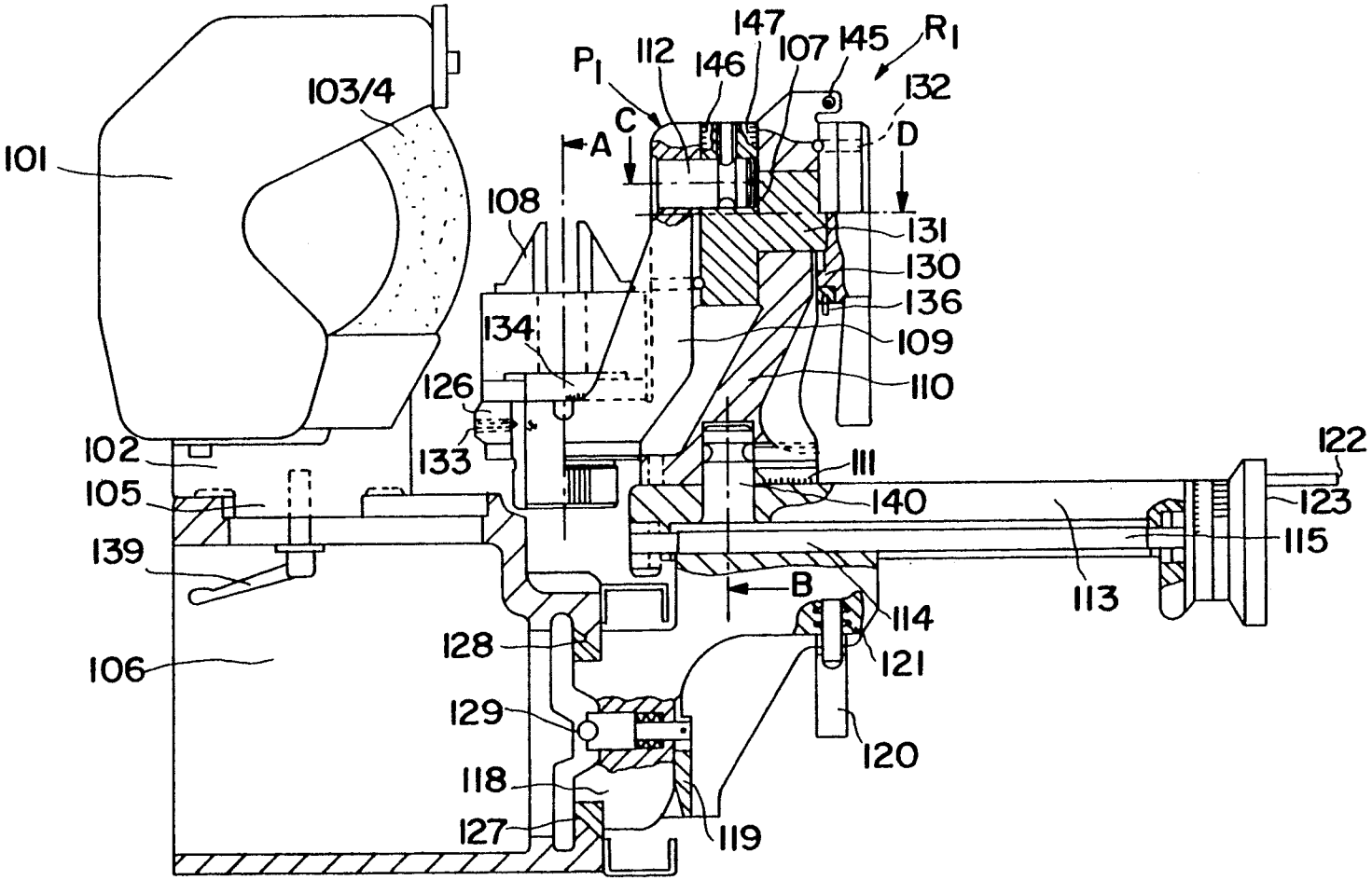
FIG. 4 shows a partially sectional side view of a further exemplary embodiment of a grinding device.
Figure 5:
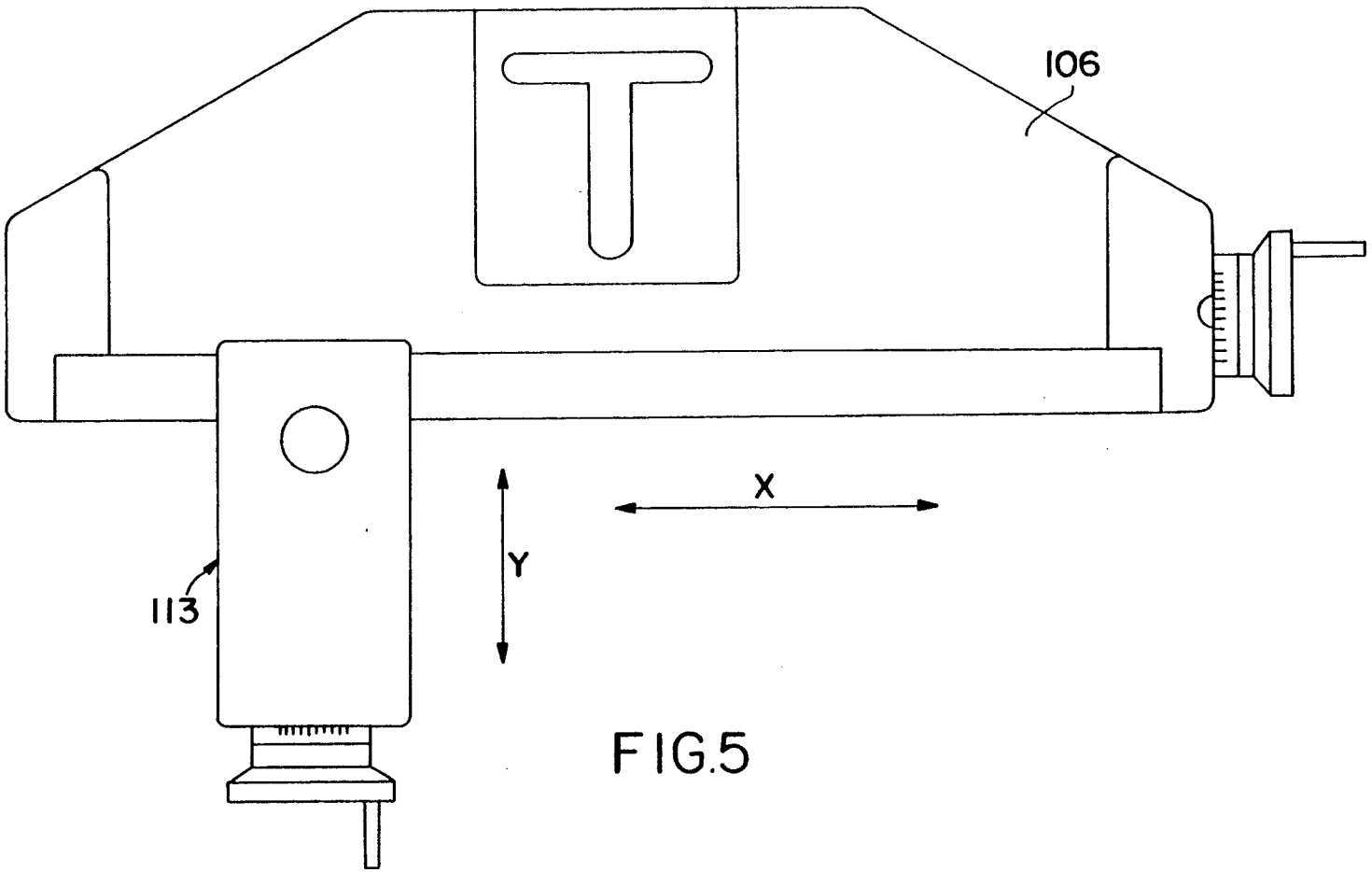
FIG. 5 shows a top view of parts of the grinding device according to FIG. 4.

In a lower (sic) embodiment, a grinding device R1 according to FIG. 4 has a double grinding unit 101 consisting essentially of a motor block 102, via which a grinding wheel 103 and 104 is driven on each of the two sides. The double grinding unit 101 includes, furthermore, a tenon block 105, via which it rests on the basic stand 106 (see FIG. 5) in a long hole.

The motor block 102 is retained via a corresponding quick-acting clamping lever 139. The double grinding unit 101 is thus designed displaceably, and furthermore it can be rotated, pivoted or changed over in reverse into various positions. This affords a time saving during the changeover of the grinding wheels.

Figure 6:
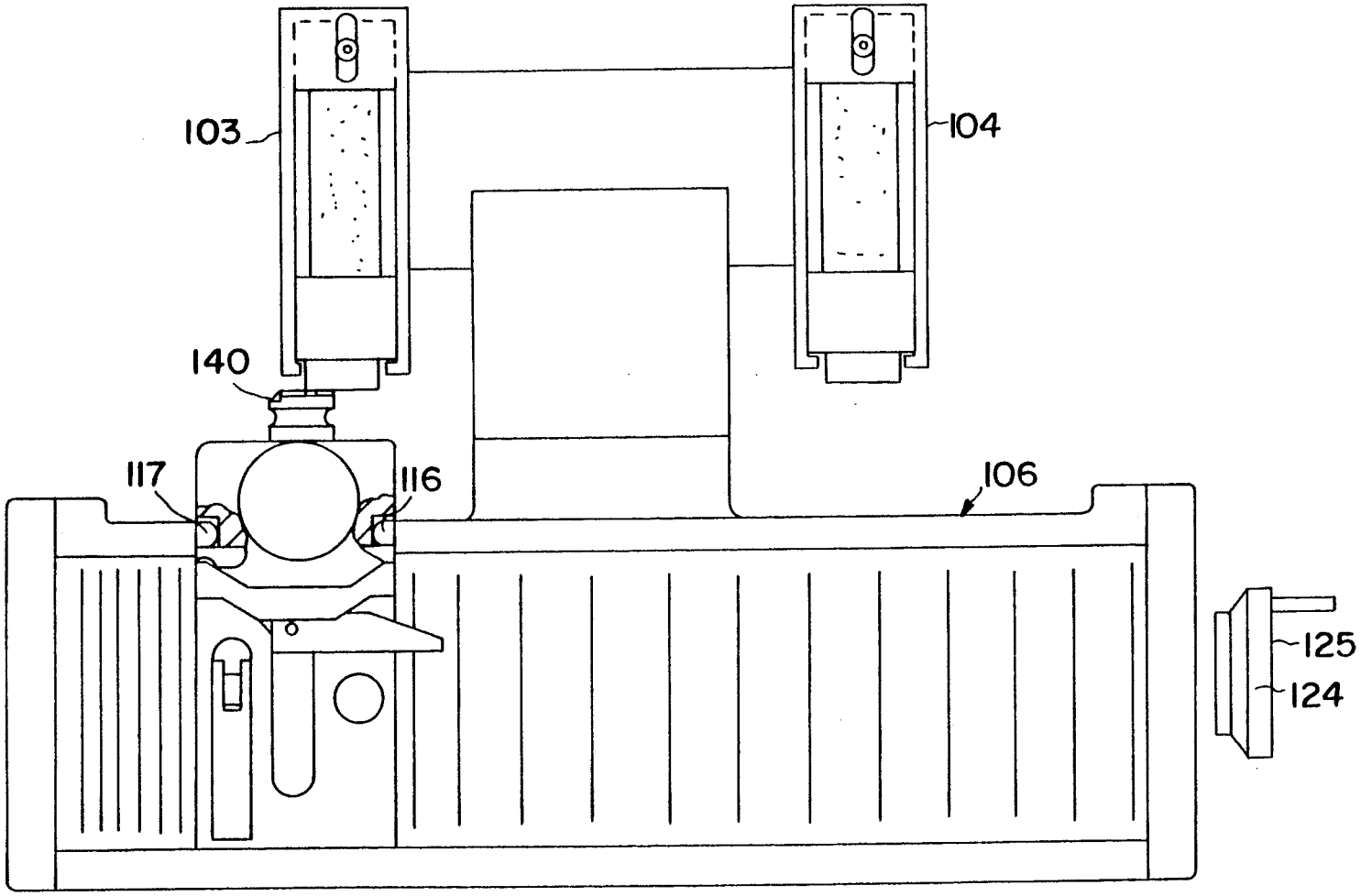
FIG. 6 shows a partial front view of the grinding device according to FIG. 4.

A quick-change holder 109 for a 6-jaw chuck 108 is received by means of a receiving bolt 112 in a receiving bore 107 of a rocker holder 110. The rocker holder 110 possesses a scale 111 for setting the point angles for a left-hand or right-hand tool. The rocker holder 110 furthermore possesses a receiving bore and is attached to an upper carriage 113 which is moveable along a guide 114. This guide 114 consists essentially of a middle threaded spindle 115 and of two lateral guide rails 116 and 117 (see FIG. 6). Both the guide rails 116 and 117 and the threaded spindle 115 pass through the upper carriage 113, but the threaded spindle 115 meshes with a corresponding internal thread in the carriage 113. The guide rails 116 and 117 run free of play and are protected against dirt.

The coarse setting of the upper carriage 113 is obtained as result of a movement along the guide 114, a lever 120 being pivoted counter to the force of a spring 121 out of its engaged position with the threaded spindle 115. As soon as the desired position is reached approximately, the lever 120 is pivoted back so that its appropriately profiled end face engages into the thread flights of the threaded spindle 115. The fine setting of the carriage position can now take place, this being carried out via a corresponding rotary grip 122 with a scaling 123. The threaded spindle 115 is rotated by means of this rotary grip 122, while the upper carriage 113 is held by the guide rails 116 and 117. The adjustment is made within the 0.01 mm range.

The y-axis guide 114 is arranged on a carriage 118 which is connected to the basic stand 106 via guide rails 127, 128 and through which a threaded spindle 129 passes.

The carriage 118 is guided on the basic stand 106 in a similar way to that described in respect of the upper carriage 113. Here too, the rapid adjustment is made by means of a lever 119, whilst the fine setting is carried out by a rotary grip 124 with an appropriate scaling 125 (see FIG. 6).

The following possibilities of movement are thus obtained:

The carriage 118 is moveable in the direction x along the basic stand 106. A displacement of the upper carriage 113 along the guide 114 allows a movement of the quick-change holder 109 in the direction y.

The rocker holder 110 has an axis of rotation B with the upper carriage 113, a further scale ring 111 being provided here too.

For the quick-change holder 109, there is, in turn, a possibility of rotation through 360° which becomes possible as result of a release of a rocker clamp 130. By this release, a rocker 131 with an appropriate scaling is relieved, so that the rocker 131 can be pivoted about a further axis of rotation D. Furthermore, as shown in FIG. 4, between the rocker 131 and the rocker holder 110 there are arranged four ball catches 132 which are respectively offset at 90° and which allow four corresponding basic positionings.

The jaw chuck 108 is arranged on an indexing drum 126 in the quick-change holder 109 which engages by means of the receiving bore 112 into the corresponding receiving bore 107 of the rocker 131. The quick-change holder 109 can thereby be exchanged rapidly. Moreover, the indexing drum 126 is mounted free of play in the quick-change holder 109, appropriate positionings being formed in the indexing drum 126 and these being assigned a ball catch or a positioning or clamping screw.

Exact positioning and reverse grinding are possible with this ball catch and positioning and clamping screw and with a scale ring 134 as result of a 12-division.

By means of various quick-change holders 109, different chucking systems can be used, as desired, for example lathe-chisel and lever-chisel quick-change holders, 6-jaw chuck quick-change holders, ISO or SK40 receiver quick-change holders, MK1 to MK4 quick-change holders and clamping-sleeve quick-change holders.

Figure 7:
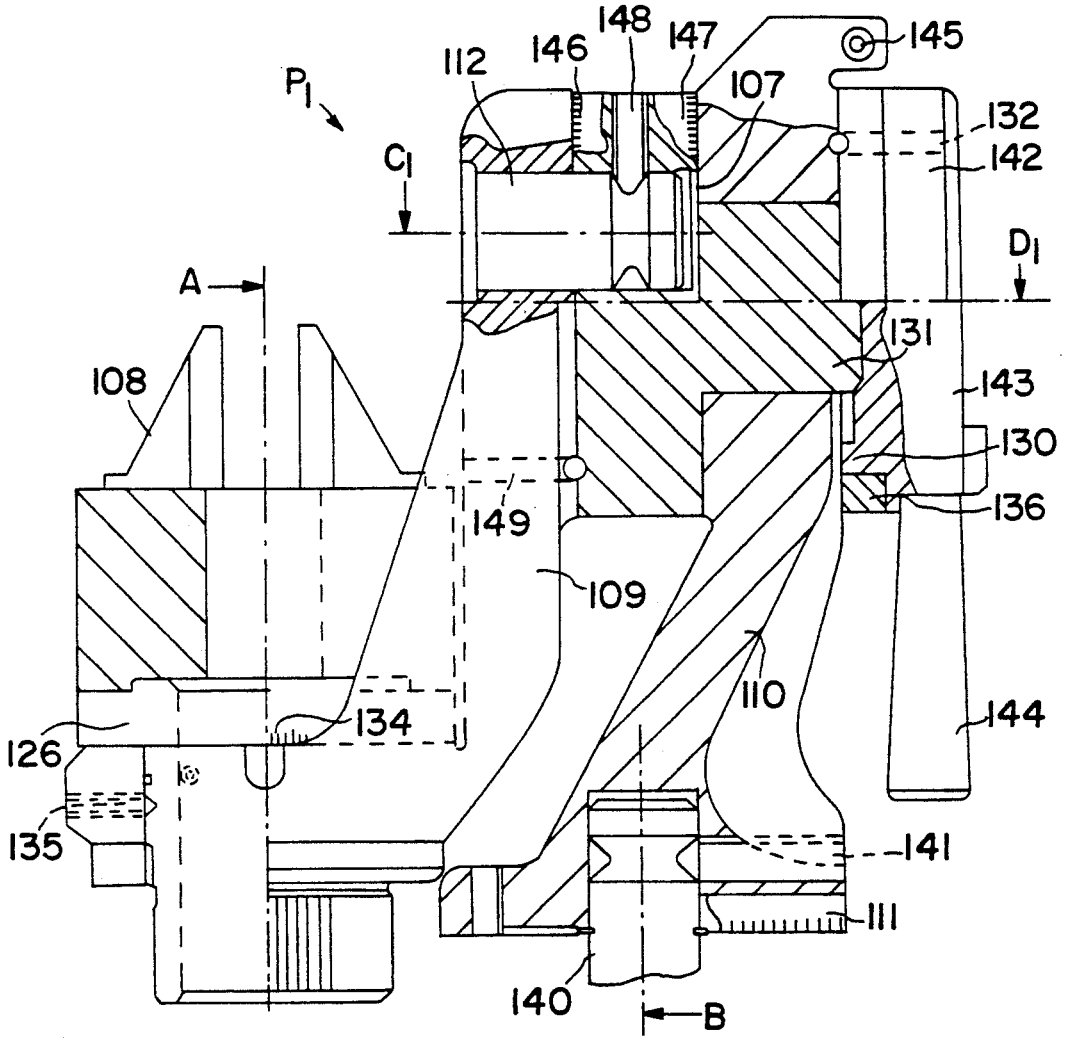
FIG. 7 shows a partially sectional side view of a working device according to the invention.
Figure 8:
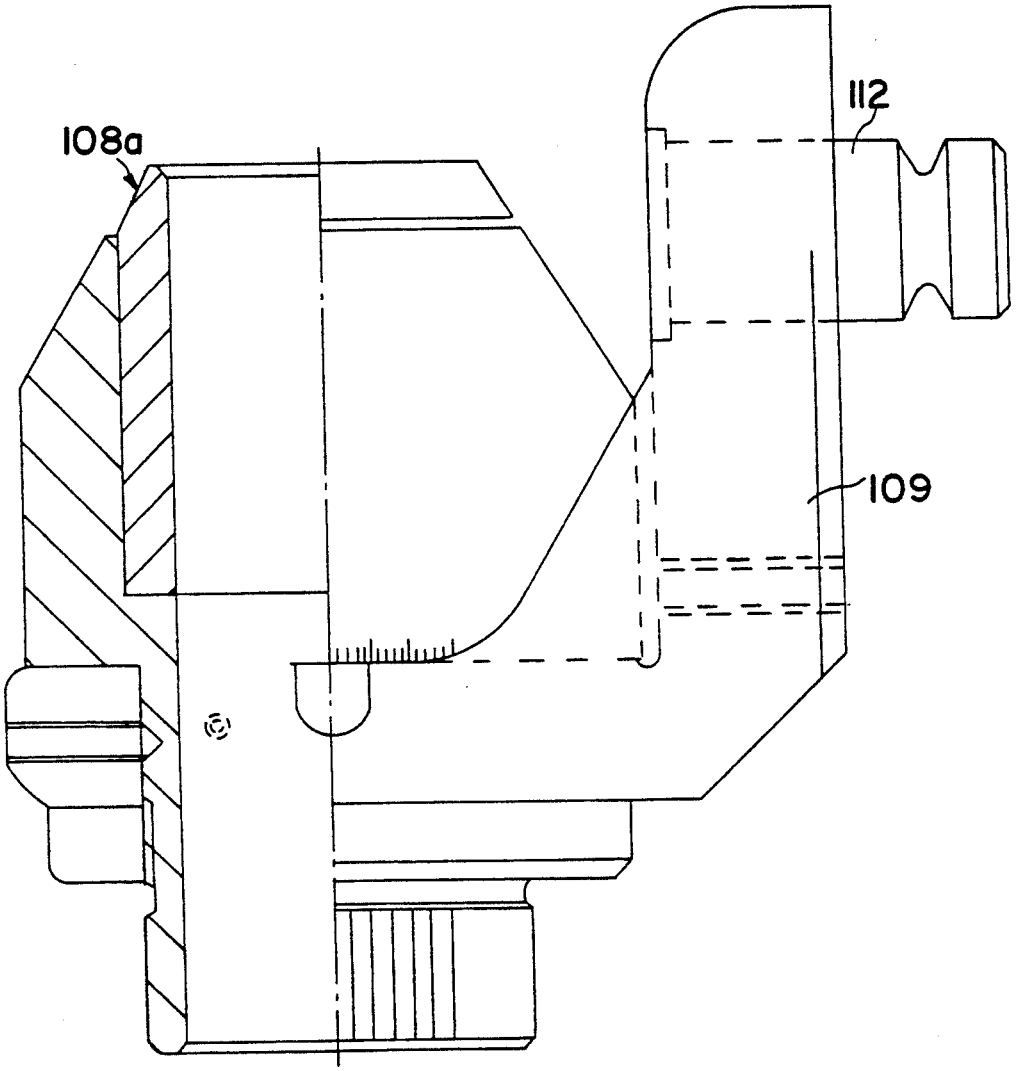
FIGS. 8–10 show embodiments of quick-change holders.
Figure 9:
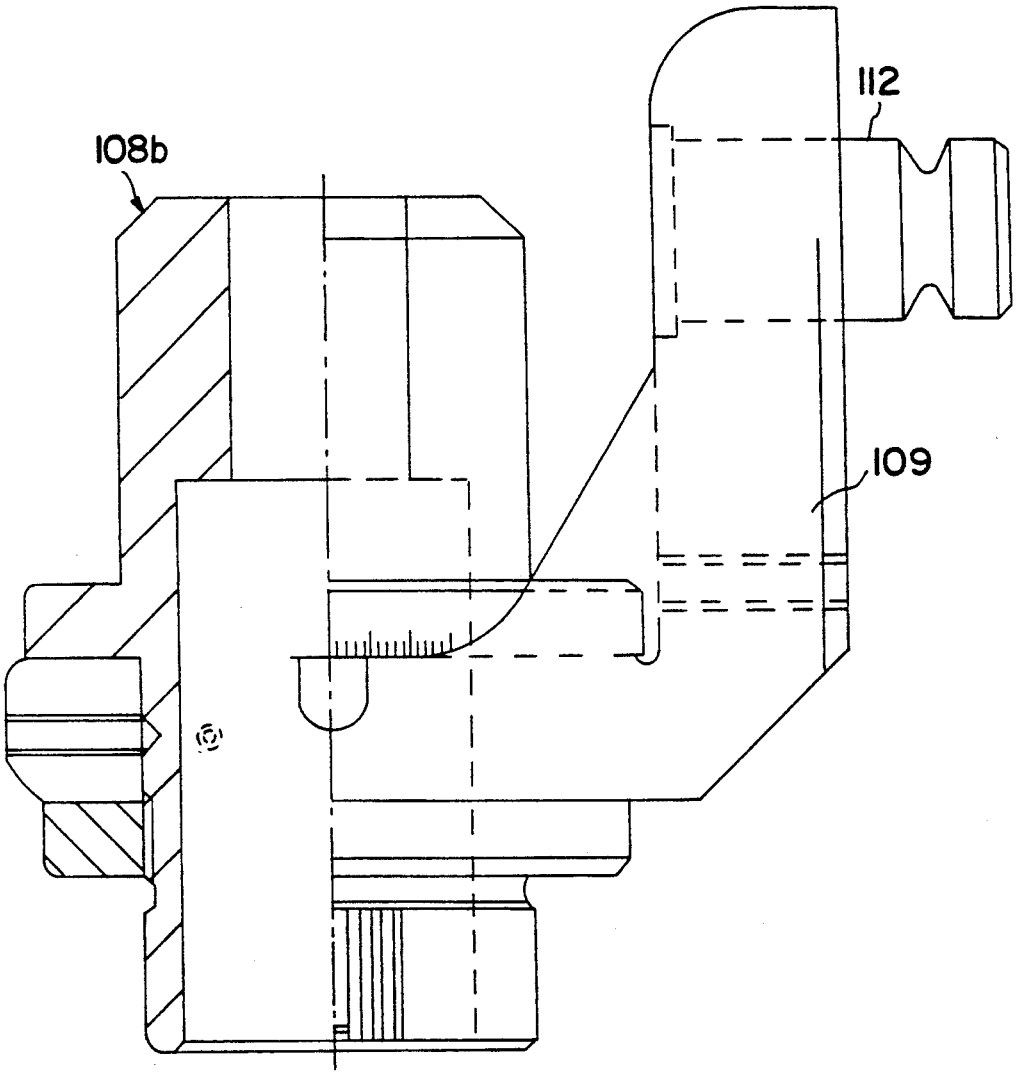
Figure 10:
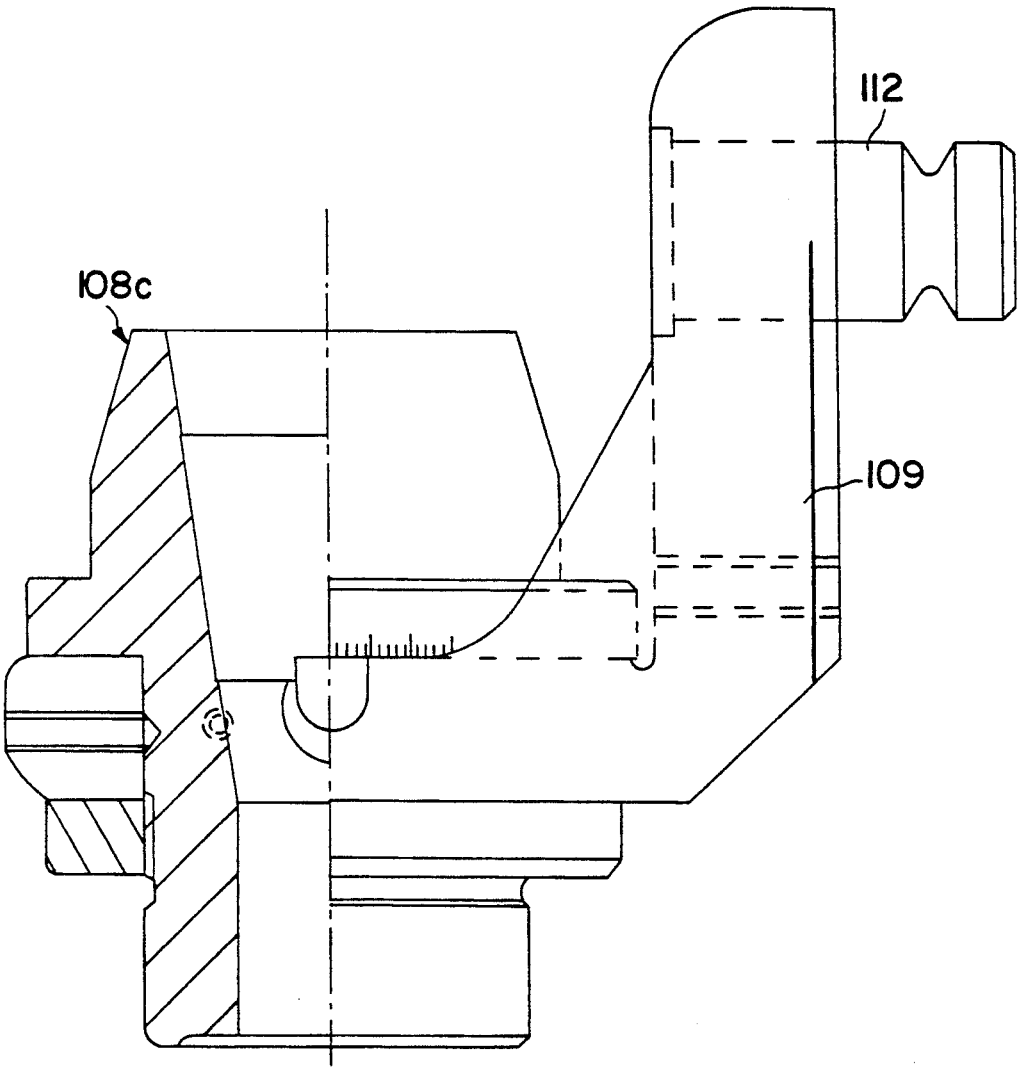

The working device P1 is shown in more detail in FIG. 7. The rocker holder 110 is arranged on a guide bolt 140 which is connected firmly to the upper carriage 113. At the same time the rocker holder 110 is rotatable about the axis B and can be fixed in a desired rotary position by means of a clamping screw 141.

The rocker 131 passes through the rocker holder 110, the rocker 131 forming the axis of rotation $D_1$ with the rocker holder 110. The rocker 131 and, together with it, the quick-change holder 109 with the jaw chuck 108 can be rotated about this axis of rotation $D_1$. At the same time, the rocker 131 is mounted free of play by means of a stay bearing 142 and can be locked by means of a rocker clamp 130. In the present exemplary embodiment, the rocker clamp 130 consists of a clamping screw which passes through a disk 143 and which comes up against the rocker holder 110. This disk 143 can be rotated about axis of rotation $D_1$, for which purpose a corresponding handle 144 is provided. The ball catch 132 can also be seen, with which the rocker 131 can be fixed in various basic positions, for example in $4 \times 90°$.

Furthermore, on the disk 143 there is also provided a stop ring 136 which interacts with a stop 145 on the rocker holder 110 in order to limit the rotation of the rocker 131 about the axis of rotation $D_1$.

The receiving bore 107 serving for the reception of the receiving bolt 112 can also be seen in the rocker 131. This receiving bolt 112 forms the axis of rotation $C_1$, about which the quick-change holder 109 rotates. At the same time, this axis of rotation $C_1$ is assigned two scale rings 146 and 147, the scale ring 146 serving for setting the quick-change holder 109 and the scale ring 147 serving for the clearance-angle setting for surface grinding. Moreover, the receiving bore 7 of the rocker 131 serves for the reception of various quick-change holders 109 which are shown by way of example in FIGS. 8 to 11.

An appropriate headless screw 148 serves for fixing the receiving bolt 112 in the receiving bore 107.

Moreover, the quick-change holder likewise forms with the rocker 131 a ball catch 149, by means of which it is possible to fix the quick-change holder 109 in various engagement positions in relation to the rocker 131.

The quick-change holder 109 comprises the jaw chuck 108, an axis of rotation A being formed here for the jaw chuck 108. Furthermore, the jaw chuck 108 rests on the indexing drum 126 which has a 12-division and a scale ring 134. This scale ring 134 serves for the exact positioning of the tool bits and for reverse grinding.

Moreover, the jaw chuck 108 is held in the quick-change holder 109 by means of a clamping and positioning screw 133, here too a ball catch being provided for the exact alignment of the tool bits.

FIGS. 8 to 11 show various receivers which are held by the respective quick-change holder 109. According to FIG. 8, it is a clamping-sleeve quick-change holder 108*a*, according to FIG. 9 a lathe and plane chisel 108*b* and according to FIG. 10 a so-called Sk40 receiver 8*c* (sic). However, these exemplary embodiments could be supplemented as desired.

We claim:

1. Apparatus for grinding workpieces, comprising:

a grinding device arranged on a basic stand, said basic stand having a first guide;

a first carriage, mounted on said first guide, said first carriage having a second guide;

a second carriage mounted on said second guide;

a rocker holder mounted on said second carriage through a guide bolt and having a first axis of rotation, said first axis of rotation forming a central axis of said guide bolt;

a rocker passing through said rocker holder so as to form a second axis of rotation between said rocker and said rocker holder, said second axis of rotation extending approximately perpendicularly to said first axis of rotation; and a receiver for said workpiece arranged on said rocker so as to form a third axis of rotation between said receiver and said rocker, said third axis of rotation extending approximately parallel and radially offset in relation to said second axis of rotation, and said receiver being supported in relation to said rocker by a ball catch so as to provide quick and accurate positioning of the receiver.

2. Apparatus according to claim 1, wherein a main axis of said receiver extends in a plane parallel to said first axis of rotations.

3. Apparatus according to claim 2, wherein said receiver has an arm approximately parallel to said second axis of rotation and said third axis of rotation, said arm holding a jaw chuck, a longitudinal axis of said jaw chuck being arranged in a plane approximately parallel to said first axis of rotation.

4. Apparatus according to claim 3, wherein said jaw chuck has an indexing drum which interacts with a scaling.

5. Apparatus according to claim 1, wherein said receiver is inserted exchangeably into said rocker.

6. Apparatus according to claim 5, wherein said receiver is arranged by means of a receiving bolt in a receiving bore of said rocker.

7. Apparatus according to claim 6, wherein said receiving bolt has two scales.

8. Apparatus according to claim 1, wherein said rocker can be fixed by a rocker clamp.

9. Apparatus according to claim 8, wherein said rocker clamp passes through a disk which is connected to said rocker.

10. Apparatus according to claim 9, wherein said disk has a ball catch disposed in relation to said rocker holder.

11. Apparatus according to claim 9, wherein said disk has a stop ring which interacts with a stop on said rocker holder.

12. Apparatus according to claim 1, wherein said first guide and said second guide each comprise threaded spindles and laterally arranged guide rails which pass through said first carriage and said second carriage, said threaded spindles having corresponding rotary grips with scalings which can be reset to zero.

13. Apparatus according to claim 1, wherein said first carriage and said second carriage each comprises a lever with an engagement profile for a threaded spindle, said lever being moveable out of an engaged position counter to a cup-spring assembly.

14. Apparatus according to claim 1, wherein a main axis of said receiver extends in a plane parallel to said first axis of rotation.

15. Apparatus according to claim 1, wherein said receiver has an arm approximately parallel to said second axis of rotation and said third axis of rotation, said arm holding a jaw chuck, a longitudinal axis of said jaw chuck being arranged in a plane approximately parallel to said first axis of rotation.

16. Apparatus according to claim 1, wherein said receiver is inserted exchangeably into said rocker.

17. Apparatus according to claim 16, wherein said receiver is arranged by means of a receiving bolt in a receiving bore of said rocker, said receiving bolt having two scales.

18. Apparatus for grinding workpiece, comprising:

a grinding device arranged on a basic stand, said basic stand having a first guide;

a first carriage, mounted on said first guide, said first carriage having a second guide;

a second carriage mounted on said second guide;

a rocker holder mounted on said second carriage and having a first axis of rotation;

a rocker arranged on said rocker holder so as to form a second axis of rotation between said rocker and said rocker holder, said second axis of rotation extending approximately perpendicularly to said first axis of rotation;

a receiver for said workpiece arranged on said rocker so as to form a third axis of rotation between said receiver and said rocker, said third axis of rotation extending approximately parallel and radially offset in relation to said second axis of rotation, said receiver having an arm being approximately parallel to said second axis of rotation, and said receiver being supported in relation to said rocker by a ball catch so as to provide quick and accurate positioning of the receiver and said third axis of rotation;

a jaw chuck arranged on said arm of said receiver, a longitudinal axis of said jaw chuck being arranged in a plane approximately parallel to said first axis of rotation, said jaw chuck having an indexing drum which interacts with a scale.

19. Apparatus for grinding workpieces, comprising:

a grinding device arranged on a basic stand, said basic stand having a first guide;

a first carriage, mounted on said first guide, said first carriage having a second guide;

a second carriage mounted on said second guide;

a rocker holder mounted on said second carriage and having a vertical first axis of rotation;

a rocker arranged on said rocker holder so as to form a second axis of rotation between said rocker and said rocker holder, said second axis of rotation extending approximately perpendicularly to said first axis of rotation; and a receiver for said workpiece arranged on said rocker so as to form a third axis of rotation between said receiver and said rocker, said third axis of rotation extending approximately parallel to said second axis of rotation, a ball catch being disposed between said receiver and said rocker so as to provide quick and accurate positioning of the receiver.

20. Apparatus for grinding workpiece, comprising:

a grinding device arranged on a basic stand, said basic stand having a first guide;

a first carriage, mounted on said first guide, said first carriage having a second guide;

a second carriage mounted on said second guide;

a rocker holder mounted on said second carriage and having a vertical first axis f rotation;

a rocker mounted on said rocker holder so as to form a second axis of rotation between said rocker and said rocker holder, said second axis of rotation extending approximately perpendicularly to said first axis of rotation, said rocker being connected to a disk by a clamp, a ball catch being disposed between said disk and said rocker holder, a stop ring being mounted on said disk for interacting with a stop mounted on said rocker holder; and a receiver for said workpiece arranged on said rocker so as to form a third axis of rotation between said receiver and said rocker, said third axis of rotation extending approximately parallel to said second axis of rotation.

* * * * *